US009994027B2

(12) United States Patent
Katsuki

(10) Patent No.: US 9,994,027 B2
(45) Date of Patent: Jun. 12, 2018

(54) CARTRIDGE HAVING A FLUID STORAGE AND A WASTE STORAGE

(71) Applicant: SEIKO EPSON CORPORATION, Tokyo (JP)

(72) Inventor: Kiyoteru Katsuki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/483,507

(22) Filed: Apr. 10, 2017

(65) Prior Publication Data

US 2017/0297342 A1 Oct. 19, 2017

(30) Foreign Application Priority Data

Apr. 15, 2016 (JP) ..... 2016-081640

(51) Int. Cl.
*B41J 2/17* (2006.01)
*B41J 2/175* (2006.01)
*B41J 29/13* (2006.01)

(52) U.S. Cl.
CPC ..... *B41J 2/1721* (2013.01); *B41J 2/1752* (2013.01); *B41J 2/1753* (2013.01); *B41J 2/1755* (2013.01); *B41J 2/17513* (2013.01); *B41J 2/17523* (2013.01); *B41J 2/17553* (2013.01); *B41J 29/13* (2013.01); *B41J 2002/17516* (2013.01)

(58) Field of Classification Search
CPC ..... B41J 2/1721; B41J 2/175; B41J 2/17503; B41J 2/17509; B41J 2/17513; B41J 2/1752; B41J 2/1753; B41J 2/17533; B41J 2/17553
See application file for complete search history.

(56) References Cited

U.S. PATENT DOCUMENTS 6,416,166 B1 7/2002 Robinson et al.
2004/0165044 A1* 8/2004 Yamada ..... B41J 2/17513 347/86

FOREIGN PATENT DOCUMENTS

JP 2003-072102 3/2003
JP 2003-300330 10/2003
JP 2007-083677 4/2007
JP 2008-049640 3/2008

* cited by examiner

*Primary Examiner* — Juanita D Jackson
(74) *Attorney, Agent, or Firm* — Workman Nydegger

(57) ABSTRACT

Technology suppressing installation of a cartridge for supplying fluid and recovering waste fluid in a wrong orientation to a fluid ejection device is provided. The cartridge has a box-shaped case. The cartridge includes a fluid pack that stores a fluid and that is disposed in the case and a waste fluid retainer that is disposed beside the fluid pack inside the case. The waste fluid retainer is configured to hold waste fluid introduced to the case from the fluid ejection device. At least one corner of a side of the case on the side on which the fluid pack is disposed is beveled.

6 Claims, 10 Drawing Sheets

CARTRIDGE HAVING A FLUID STORAGE AND A WASTE STORAGE

CROSS-REFERENCE TO RELATED APPLICATIONS

The present application claims priority to Japanese Patent Application No. 2016-081642 filed Apr. 15, 2016, which is hereby incorporated by reference in its entirety.

BACKGROUND

1. Technical Field

Embodiments of the invention relate to a cartridge.

2. Related Art

Cartridges that are removably installed are commonly used in inkjet printers and other fluid ejection devices. As an example of a cartridge of this type, JP-A-2003-300330, for example, describes an ink tank having both an ink storage unit and waste ink storage unit. A fluid supply port (ink removal unit) for supplying ink from the ink storage to the printer, and a waste fluid inlet (waste ink recovery unit) through which waste ink from the printer is introduced to the waste ink storage are disposed in the bottom of the ink tank. An ink supply needle and a waste ink recovery needle are disposed in the ink tank holder of the printer, and when an ink tank is installed in the ink tank holder, the ink supply needle is inserted into the fluid supply port, and the waste ink recovery needle is inserted into the waste ink inlet.

The ink tank described in JP-A-2003-300330 is substantially rectangular in a section view perpendicular to the direction in which the ink tank is installed to or in the ink tank holder (the insertion direction). As a result, the correct orientation of the ink tank for installing the ink tank into the ink tank holder is not obvious. In fact, the ink tank can be easily inserted into the ink tank holder in the wrong orientation. Technology that suppresses installing a cartridge used to supply fluid and recover waste fluid to a fluid ejection device in the wrong orientation is therefore needed.

SUMMARY

Embodiments of the present invention are directed to solving at least part of the foregoing problem, and can be embodied as described in the following embodiments and variations.

(1) A cartridge that installs to or in a cartridge holder disposed to or in a fluid ejection device is provided. The cartridge includes a box-shaped case, a fluid pack that stores a fluid and that is disposed in the case. The cartridge includes a waste fluid retainer disposed beside or at the side of the fluid pack in the case. The waste fluid retainer holds waste fluid introduced from the fluid ejection device into the case. At least one corner of the side of the case on the side on which the fluid pack is disposed is beveled.

Because at least one corner of a side of the case of a cartridge configured according to this aspect of the invention is beveled, the shape of the cartridge differs according to the direction from which the case is seen or viewed. Installing the cartridge to or in the cartridge holder in the wrong orientation can therefore be suppressed. Furthermore, because at least one corner of the side on which the fluid pack is located is beveled, the shape of the fluid pack inside the case can be kept stable. More specifically, the fluid pack can be stably held inside the case. As a result, wrinkling or damage to the fluid pack during transportation of the cartridge, for example, can be suppressed.

(2) In a cartridge according to another aspect of the invention, the case includes, in or on a side, a wrong-insertion prevention pin that, when the cartridge is installed in the cartridge holder, fits into a channel formed in an inside wall of the cartridge holder. When looking at the case from the direction in which the cartridge is installed to or in the cartridge holder, the wrong-insertion prevention pin is located at a position that is offset from the center of the side to which the wrong-insertion prevention pin is disposed.

This cartridge configuration can more reliably suppress installation of the cartridge in the wrong orientation to or in the cartridge holder. In other words, a cartridge configured with a wrong-insertion prevention pin can help prevent the cartridge from being installed incorrectly or in the wrong orientation.

(3) In a cartridge according to another aspect of the invention, the cartridge holder includes a first positioning pin and a second positioning pin protruding in the direction toward the case or extending from a wall or base of the cartridge holder. The case has a bottom wall that includes a fluid supply port that communicates with the fluid pack, a waste fluid inlet that communicates with the waste fluid retainer, a first positioning hole which is configured to receive the first positioning pin, and a second positioning hole that is configured to receive the second positioning pin. During installation, the first positioning pin and the second positioning pin enter, respectively, the first positioning hole and the second positioning hole. When looking at the case from the bottom wall side, an imaginary first line through the first positioning hole and second positioning hole passes between the fluid supply port and the waste fluid inlet.

This cartridge configuration can improve the precision with which the cartridge is installed to or in the cartridge holder.

(4) In a cartridge according to another aspect of the invention, the bottom wall has a protrusion that projects farther than the fluid supply port and waste fluid inlet to the cartridge holder side. The protrusion thus extends away from the bottom wall in one embodiment.

This cartridge configuration can suppress the surface on which the cartridge is placed from becoming soiled by contact with the fluid supply port and waste fluid inlet.

Embodiments of the invention are not limited to cartridge configurations such as described above, and can be embodied in many ways. For example, the invention can be embodied as a fluid supply system for supplying fluid to a fluid ejection device, and as a fluid ejection device that includes a cartridge.

Other objects and attainments together with a fuller understanding of the invention will become apparent and appreciated by referring to the following description and claims taken in conjunction with the accompanying drawings.

DESCRIPTION OF EMBODIMENTS

A. Embodiment

Figure 1:
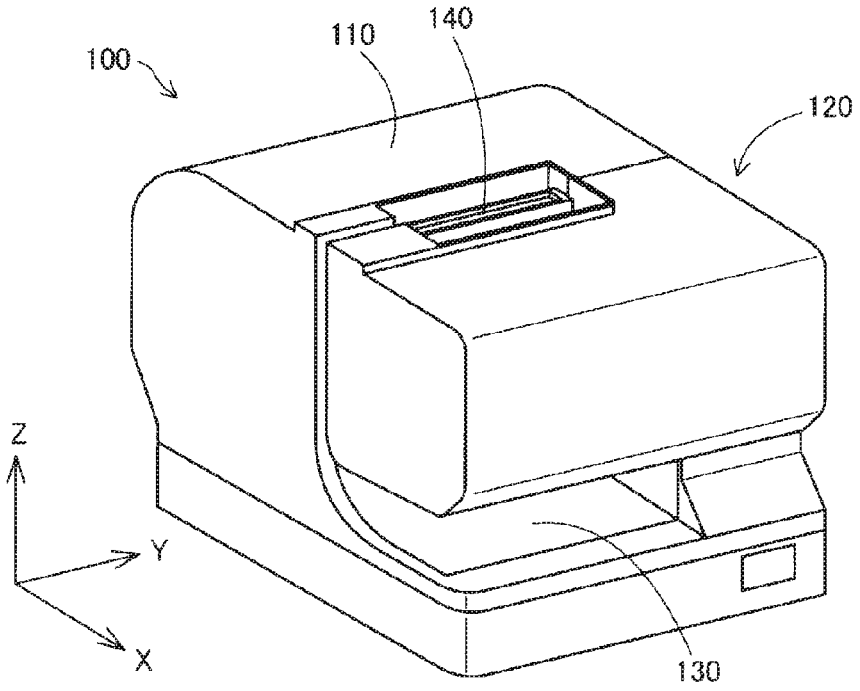
FIG. 1 is an oblique view of a printer.

FIG. 1 is an oblique view of a printer 100. The printer 100 is an example of a fluid ejection device to or in which a cartridge according to embodiments of the invention is removably installed. Three mutually perpendicular axes, XYZ, are shown in FIG. 1. The arrows of the X, Y, Z axes point to the positive direction on the X, Y, Z axes. The positive directions on the X, Y, Z axes are referred to below as the +X direction, +Y direction, and +Z direction. The direction opposite the direction in which the arrows of the X, Y, Z axes point is the negative direction on the X, Y, Z axes. The negative directions on the X, Y, Z axes are referred to below as the −X direction, −Y direction, and −Z direction. Locations not referenced to the positive or negative direction on the X, Y, Z axes may be referred to simply the X-axis, Y-axis, or Z-axis. The same references are used in the other figures and the following description. The X, Y, Z axes in the other figures also correspond to the X, Y, Z axes in FIG. 1.

When a printer 100 according to this embodiment is placed on a horizontal surface, the direction from the back of the printer to the front of the printer 100 is the +X direction, the direction from the bottom of the printer to the top of the printer 100 is the +Z direction, and the direction from the left to the right when looking at the printer 100 from the front is the +Y direction. Below, the side on the +Z direction side is referred to as the "top," and side on the −Z direction side is referred to as the "bottom." The −Z direction is the direction in which gravity works. "Sides" as used below refer to the surfaces other than the side facing up in the +Z direction (the top), and the side facing down in the −Z direction (the bottom).

The printer 100 is an inkjet printer that ejects ink from a head and prints on recording media. The printer 100 in this example may be used as a business printer that is installed in a store, for example, and prints on roll paper for receipts and sheet paper. The printer 100 has a roll paper compartment 110 in which roll paper is stored, a cartridge compartment 120 in which a cartridge is stored or installed, a sheet entrance 130 through which cut-sheet paper is inserted, and a paper exit 140 from which roll paper or single sheets are discharged after printing.

Figure 2:
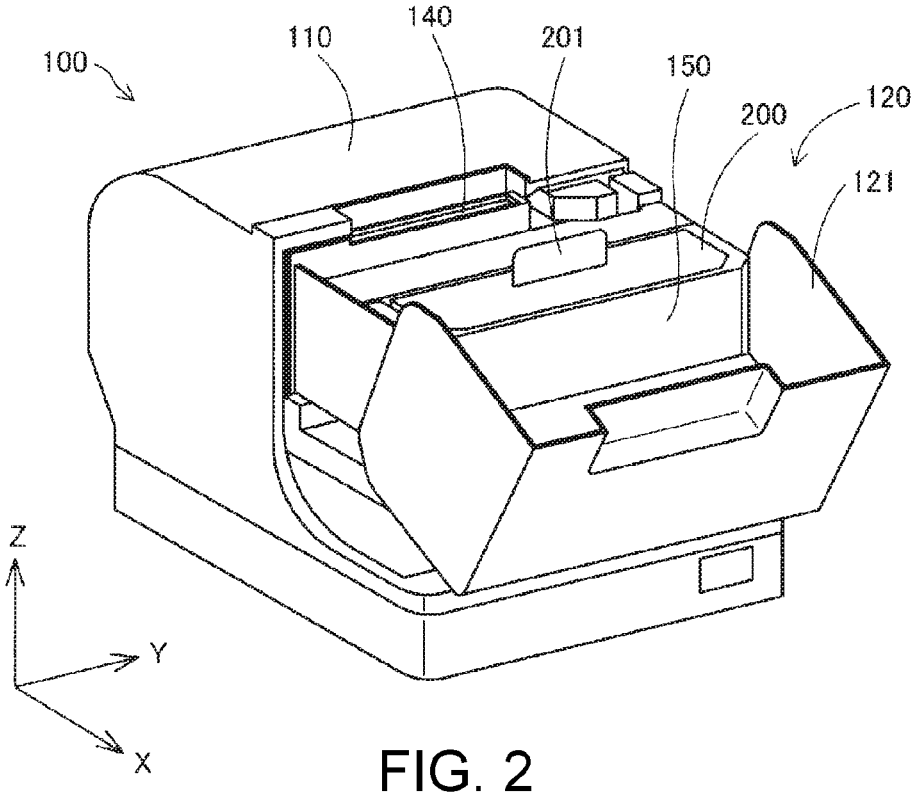
FIG. 2 is an oblique view showing an embodiment of a cartridge installed to or in the printer.

FIG. 2 is an oblique view of the printer 100 with a cartridge 200 installed. The cartridge compartment 120 has a cover 121 that opens to or towards the front of the printer 100. A cartridge holder 150, in which the cartridge 200 is removably installed, is inside the cover 121. Thus, the cartridge holder 150 is exposed when the cover 121 is opened. The cartridge 200 is inserted to or in the cartridge holder 150 in the −Z direction. The −Z direction in which the cartridge 200 is installed to or in the cartridge holder 150 is referred to below as the "insertion direction." The state when the cartridge 200 is installed in the cartridge holder 150 of the printer 100 is referred to below as being "installed" or the "installed state." The cartridge 200 can be inserted into the cartridge holder 150 when moving the cartridge 200 in the −Z direction (installing the cartridge 200) or removed from the cartridge holder 150 by moving the cartridge 200 in the +Z direction (removing the cartridge 200).

A flat grip 201 extending on the Y-axis is disposed to the top of the cartridge 200. Holding the grip 201, a user can install the cartridge 200 to or in the cartridge holder 150. The user can also remove the cartridge 200 from the cartridge holder 150 by holding the grip 201 and pulling the cartridge 200 up in the +Z direction. The grip 201 can also fold flat. When the cover 121 is closed after the cartridge 200 has been installed in the cartridge holder 150, the grip 201 touches the inside of the cover 121 and folds down to the back of the printer 100. In one example, the cover 121 folds the grip 201. The grip 201 may be centrally positioned in the X axis and/or Y axis direction or offset from a central position.

As shown in FIG. 2, only one cartridge 200 is installed in the cartridge holder 150. In other words, the printer 100 in this embodiment is a monochrome printer. Furthermore, while not shown in detail in the figures, the cartridge 200 is separate from the printhead in the printer 100 according to this embodiment, and a tube connects the cartridge 200 to the printhead. More specifically, the printer 100 may be an off-carriage printer. More specifically, the printer 100 is a printer in which the cartridge holder 150 does not move in conjunction with the printhead (carriage). In this embodiment, the printhead is disposed to or on the back side of the cartridge holder 150. The printhead, while moving bidirectionally on the Y-axis, ejects ink supplied through the tube from the cartridge 200 onto the recording medium. The printer 100 has an internal pump for pressure feeding ink that is supplied from the cartridge 200 but not used for printing as waste ink (waste fluid) back into the cartridge 200.

Figure 3:
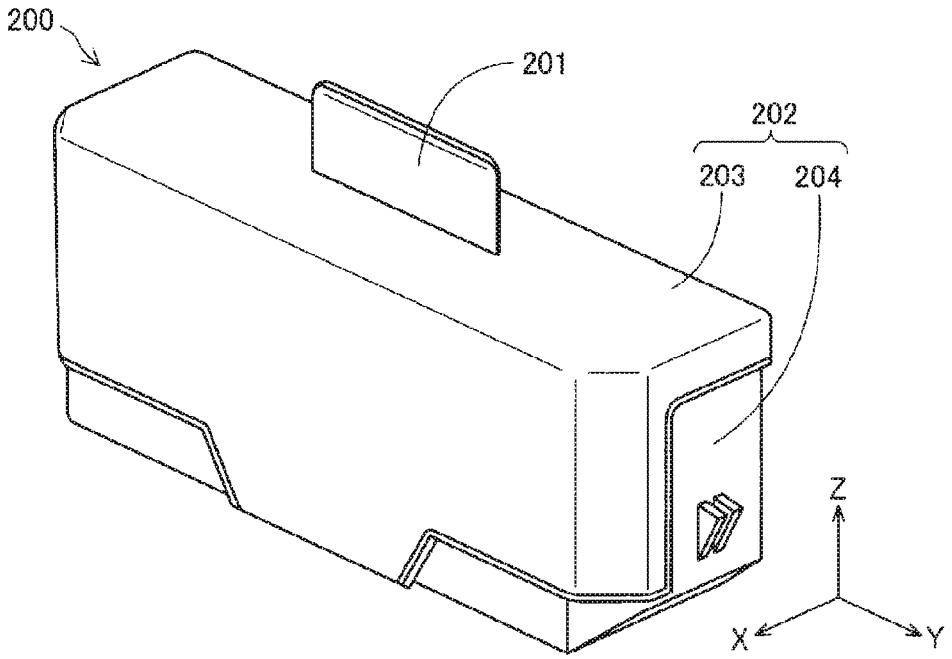
FIG. 3 is a first oblique view of the cartridge.
Figure 4:
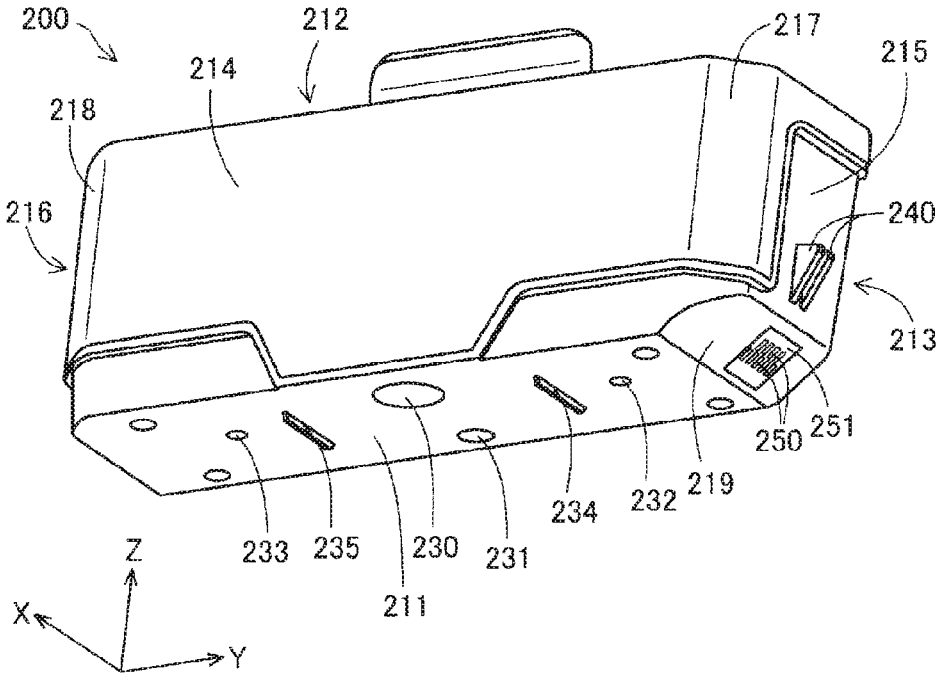
FIG. 4 is a second oblique view of the cartridge.
Figure 5:
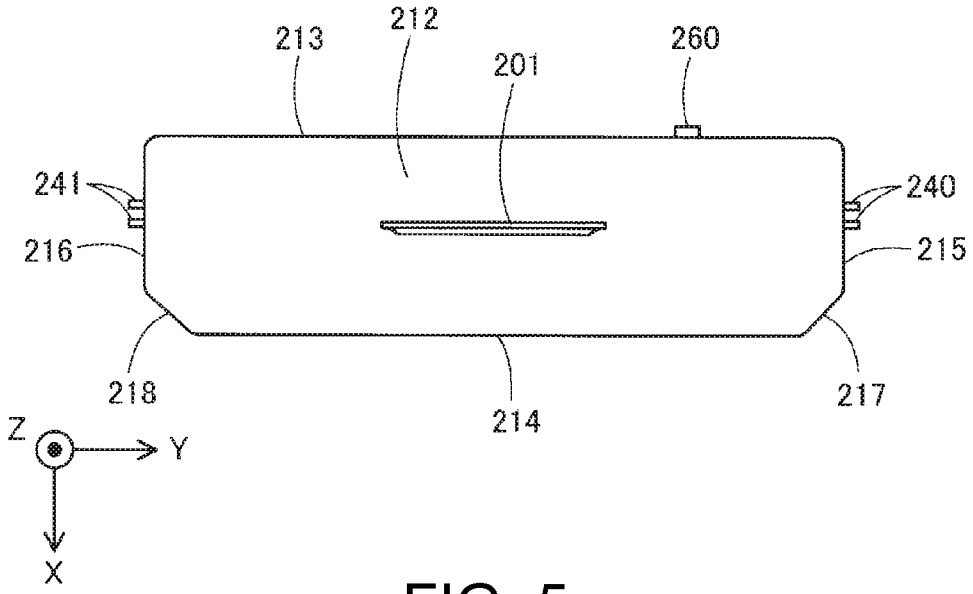
FIG. 5 is a top view of the cartridge.
Figure 6:
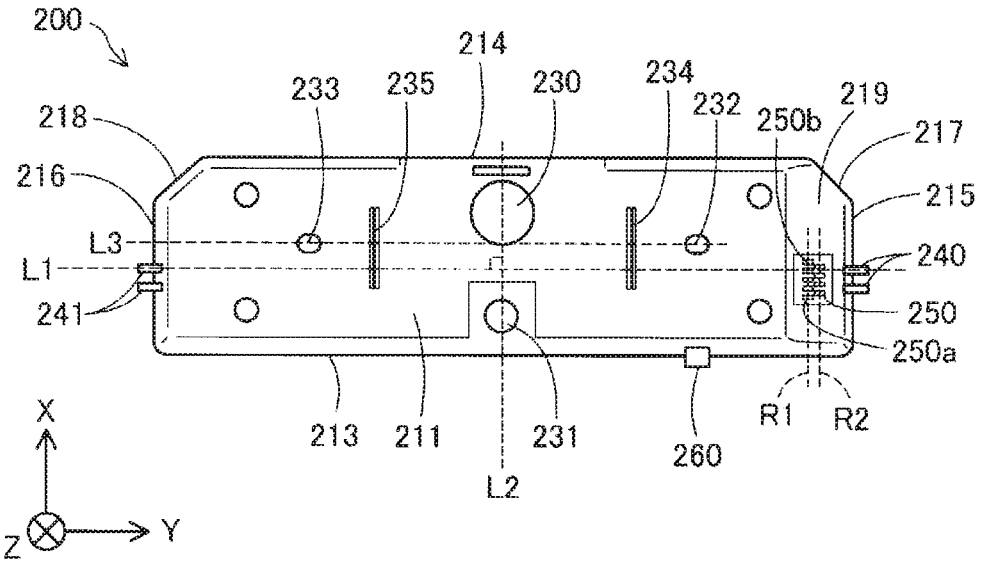
FIG. 6 is a bottom view of the cartridge.
Figure 7:
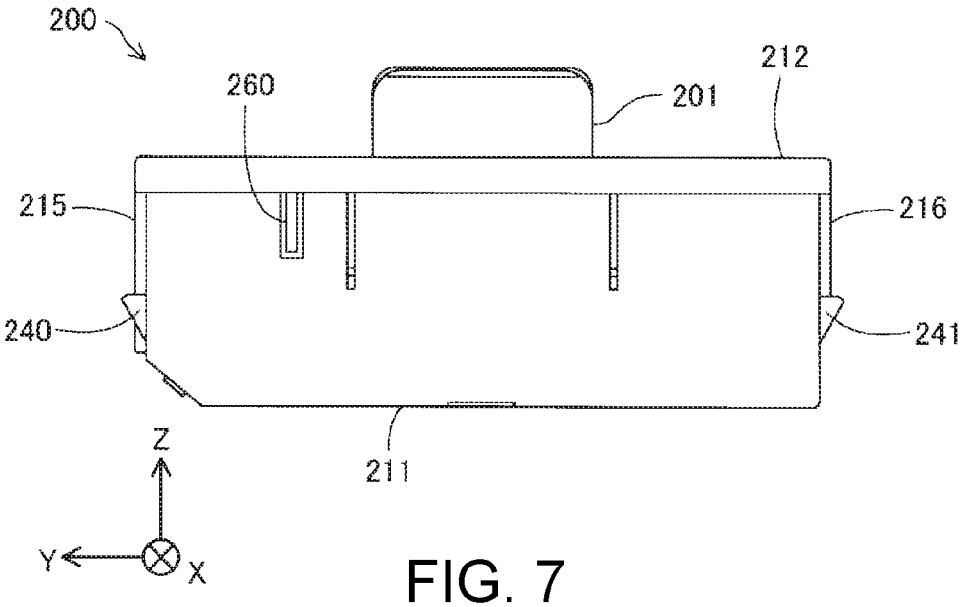
FIG. 7 is a back view of the cartridge.

FIG. 3 is a first oblique view of the cartridge 200. FIG. 4 is a second oblique view of the cartridge 200. FIG. 5 is a top view of the cartridge 200. FIG. 6 is a bottom view of the cartridge 200. FIG. 7 is a back view of the cartridge 200. The configuration of the cartridge 200 is described below with reference to these figures. As shown in the figures, the cartridge 200 has a basically rectangular box shape, is longest on the Y-axis, and shortest on the X-axis. In other words, the outside dimensions of the cartridge 200 decrease in size from the Y-axis dimension to the Z-axis dimension and then the X-axis dimension.

As shown in FIG. 3, the cartridge 200 has a box-like case 202. The case 202 is configured to snap-fit together by pushing the plastic top member 203 together with the plastic bottom member 204. The grip 201 is formed in unison with or integrally with the top member 203. The top member 203 may be pushed together vertically with the plastic bottom member 204 to connect the top member 203 with the bottom member 204.

As shown in FIG. 4 to FIG. 7, the cartridge 200 has a first wall (bottom wall) 211, second wall 212 (top wall), third wall 213, fourth wall 214, fifth wall (first side wall) 215, sixth wall (second side wall) 216, seventh wall 217, and eighth wall 218. Some embodiments may not include some of these walls (e.g., the seventh wall 217 and the eighth wall 218. Below, two wall members "meeting" or "intersecting" means that the two wall members are mutually connected; when one wall member is extended, it meets the other wall member; or that when both wall members are extended, they meet. If two wall members are said to be "opposite" each other or in opposition, another object may or may not be present between the two wall members.

The outside surface of each wall 211 to 218 is substantially flat. Substantially flat as used herein includes both the entire surface being completely flat, and the surface having a protrusion or indent in some part or portion of the wall. More specifically, substantially flat includes being able to recognize surfaces and walls of the case 202 of the cartridge 200 even if there are some protrusions or indentations on part of the surface. The outside shape of each of the first wall 211 to eighth wall 218 is substantially rectangular.

The first wall 211 and second wall 212 are wall members parallel to the X-axis and Y-axis. The second wall 212 is opposite the first wall 211. In other words, the first wall 211 and second wall 212 are opposite each other on the Z-axis. The first wall 211 is on the −Z direction side, and the second wall 212 is on the +Z direction side. The first wall 211 and second wall 212 meet the third wall 213, fourth wall 214, fifth wall 215, sixth wall 216, seventh wall 217, and eighth wall 218. In this embodiment, when the cartridge 200 is installed to or in the cartridge holder 150, the first wall 211 forms the bottom of the cartridge 200, and the second wall 212 forms the top of the cartridge 200. The first wall 211 is also referred to below as the bottom wall 211.

As shown in FIG. 4 and FIG. 6, the bottom wall 211 may include a fluid supply port 230 for supplying ink to the printer 100, and may include a waste fluid inlet 231 for recovering waste fluid from the printer 100. In this embodiment of the invention, the bottom wall 211 has a first positioning hole 232 in which a first positioning pin 151 disposed to or on the cartridge holder 150 (FIG. 8) is inserted, and a second positioning hole 233 to which a second positioning pin 152 disposed to or on the cartridge holder 150 is inserted. Also in this embodiment, the bottom wall 211 has a first protrusion 234 and second protrusion 235 that protrude more to the cartridge holder 150 side (−Z direction side) than the fluid supply port 230 and waste fluid inlet 231. The first protrusion 234 and second protrusion 235 in this embodiment are formed as ribs on the case 202. In other words, the first and second protrusions 234 and 235 extend outwardly from the bottom wall 211. Note that either or both the first protrusion 234 and second protrusion 235 may be omitted.

In this embodiment, the fluid supply port 230 and waste fluid inlet 231 are disposed at the same position on the Y-axis. In other words, the direction in which the fluid supply port 230 and waste fluid inlet 231 are aligned is on the X-axis, and parallel to the fifth wall 215 and sixth wall 216. In this example, the waste fluid inlet 231 is closer to the third wall 213 than the fluid supply port 230. The positions of the first positioning hole 232 and second positioning hole 233 on the X-axis are the same.

The third wall 213 and fourth wall 214 are wall members that are parallel to the Y-axis and Z-axis. The third wall 213 and fourth wall 214 are opposite each other on the X-axis. The third wall 213 is on the −X direction side, and the fourth wall 214 is on the +X direction side. The third wall 213 intersects the first wall 211 and second wall 212, and intersects the fifth wall 215 and sixth wall 216. The fourth wall 214 intersects the first wall 211 and second wall 212, and is opposite the third wall 213. The fourth wall 214 also intersects the seventh wall 217 and eighth wall 218. In this embodiment, when the cartridge 200 is installed in the cartridge holder 150, the fourth wall 214 faces the front of the printer 100, and the third wall 213 faces the back of the printer 100.

As shown in FIG. 5 to FIG. 7, a wrong-insertion prevention pin 260 that prevents the cartridge 200 from being installed in the wrong orientation to or in the cartridge holder 150 is disposed to or on the third wall 213, which third wall 213 forms one side of the case 202 of the cartridge 200. The wrong-insertion prevention pin 260, when looking at the case 202 of the cartridge 200 in the insertion direction, is disposed at a position that is offset from the center of the side (third wall 213) on which the wrong-insertion prevention pin 260 is disposed. In this embodiment, the wrong-insertion prevention pin 260 is disposed to or at a position that is offset toward the fifth wall 215 from the center of the third wall 213.

The fifth wall 215 and sixth wall 216 are wall members parallel to the X-axis and Z-axis. The fifth wall 215 and sixth wall 216 are opposite each other on the Y-axis. The fifth wall 215 intersects the first wall 211, second wall 212, third wall 213, and seventh wall 217. The sixth wall 216 intersects the first wall 211, second wall 212, third wall 213, and eighth wall 218, and is opposite the fifth wall 215. In this example, when the cartridge 200 is installed in the cartridge holder 150, the fifth wall 215 faces the right side of the printer 100, and the sixth wall 216 faces the left side of the printer 100. The fifth wall 215 is also referred to as the first side wall 215, and the sixth wall 216 is also referred to as the second side wall 216.

The first side wall 215 has a first catch 240. The first catch 240 functions as a first contact part that can contact a first fastening member 153 disposed to or on the cartridge holder 150 (FIG. 8, FIG. 9) when the cartridge 200 is installed. The sixth wall 216 has a second catch 241. The second catch 241 functions as a second contact part that can contact a second fastening member 154 when the cartridge 200 is installed. As shown in FIG. 5 and FIG. 6, the first catch 240 and second catch 241 are at the same position on the X-axis. In other words, the direction in which the first catch 240 and second catch 241 are aligned is on the Y-axis, which is parallel to the third wall 213 and fourth wall 214.

As shown in FIG. 7, in the installed position, the location of the first catch 240 and second catch 241 on the Z-axis is below (on the −Z direction side) ½ the height (distance) from the bottom wall 211 to the second wall 212. In this example, the first catch 240 and second catch 241 are also at the same position on the Z-axis. Of the wall members forming the case 202, the first side wall 215 to which the first catch 240 is disposed, and the second side wall 216 to which the second catch 241 is disposed, are the wall members disposed to positions with the greatest distance therebetween. The first catch 240 and second catch 241 are therefore disposed to the case 202 with a greater distance therebetween than if they were disposed to or on other wall members. In other words, the first side wall 215 and the second side wall 216 are the furthest apart of the opposing walls of the case 202.

As shown in FIG. 4 and FIG. 5, the seventh wall 217 is a wall member parallel to the Z-axis. The seventh wall 217 is a wall member connecting the fifth wall 215 and fourth wall 214 at one side of the case 202. The seventh wall 217 intersects the first wall 211 and second wall 212, and intersects the fifth wall 215 and fourth wall 214. The seventh wall 217 is formed by beveling the corner between the fifth wall 215 and fourth wall 214.

The eighth wall 218 is also a wall member parallel to the Z-axis. The eighth wall 218 is a wall member connecting the sixth wall 216 and fourth wall 214 on one side of the case 202. The eighth wall 218 intersects the first wall 211 and second wall 212, and intersects the sixth wall 216 and fourth wall 214. The eighth wall 218 is formed by beveling the corner between the sixth wall 216 and fourth wall 214.

Note that the seventh wall 217 and eighth wall 218 are formed so that they would intersect each other if each was extended to the front (+X direction) of the cartridge 200. If each was extended to the back (−X direction) of the cartridge 200, the seventh wall 217 and eighth wall 218 would also intersect extensions of the third wall 213 on the Y-axis.

As shown in FIG. 4, the bottom wall 211 has, on the end on the +Y direction side, that is, the end on the fifth wall 215 side, an inclined portion 219 that slopes in the opposite direction as (away from) the cartridge holder 150 or away from a surface or wall (e.g., a bottom surface or wall) of the cartridge holder 150. The inclined portion 219 may also be considered a wall portion connecting the first wall 211 to the fifth wall 215.

The inclined portion 219 may include multiple electrode contacts 250 that, when in the installed position, electrically connect to multiple electrodes 155 (FIG. 8) disposed to or on the cartridge holder 150. In this embodiment, the electrode contacts 250 are disposed to or on a circuit board 251 affixed to the outside of the inclined portion 219. In other words, the circuit board 251 has multiple electrode contacts 250 that, when in the installed position, contact the electrodes 155 disposed to the cartridge holder 150. More specifically, the electrode contacts 250 are an area where terminals (contacts) disposed on the surface of the circuit board 251 electrically and physically contact the electrodes 155. As shown in FIG. 6, in this embodiment, the multiple electrode contacts 250 may be formed in a first row R1 and a second row R2 with a specific gap therebetween on the Y-axis when seen from the −Z direction. The second row R2 is on the +Y direction side of the first row R1. In this embodiment, there are five electrode contacts 250 aligned on the X-axis in the first row R1, and four electrode contacts 250 aligned on the X-axis in the second row R2.

A memory device 252 (FIG. 12) for storing information about the cartridge 200 may be disposed to or on the back side of the circuit board 251 on which the electrode contacts 250 are disposed. Information about an amount of remaining ink and the color of the ink in the cartridge 200, for example, may be stored in the memory device 252. When the electrodes 155 disposed to or on the cartridge holder 150 contact the electrode contacts 250, a control circuit of the printer 100 can read information from or stored in the memory device 252.

Figure 8:
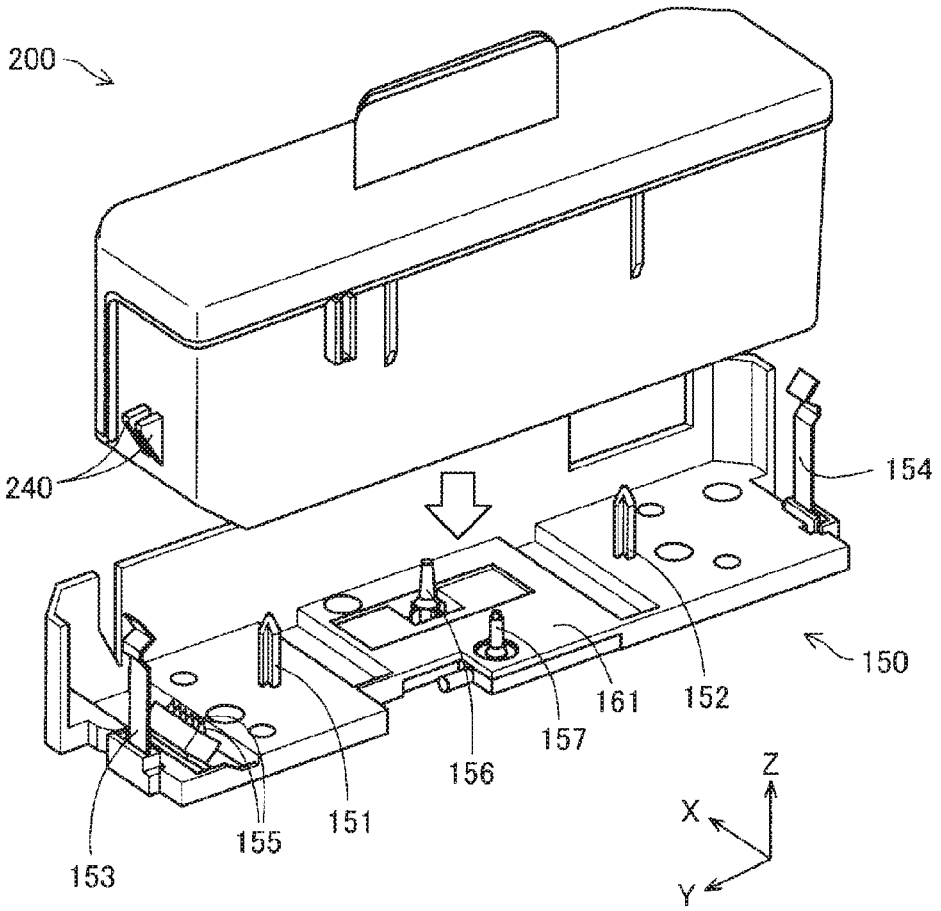
FIG. 8 illustrates installing the cartridge to or in the cartridge holder.
Figure 9:
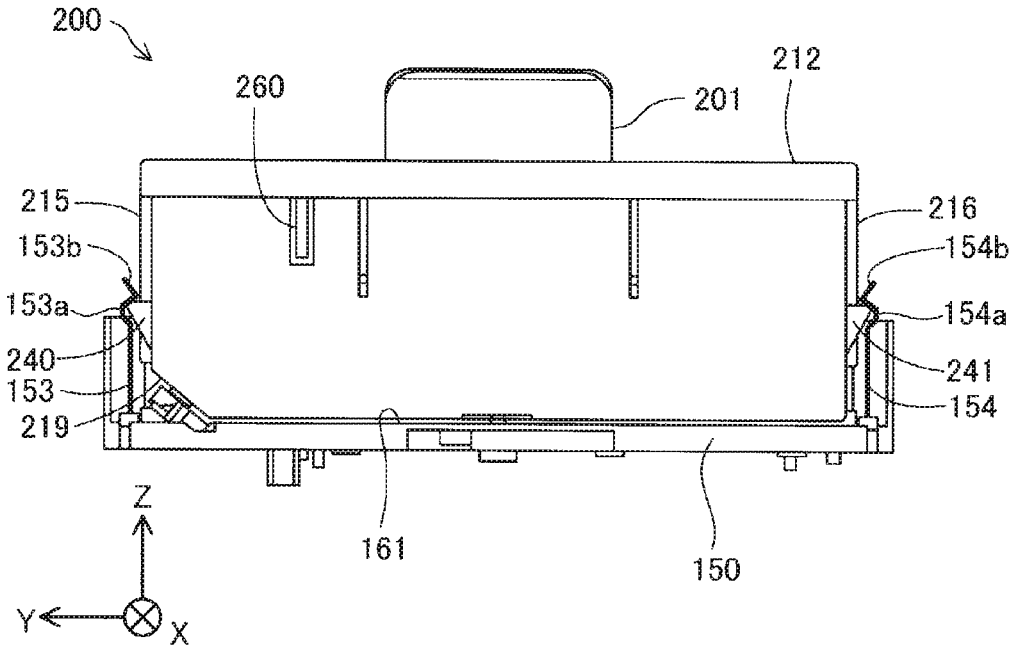
FIG. 9 shows the cartridge installed in the cartridge holder.

FIG. 8 illustrates installing the cartridge 200 to or in the cartridge holder 150. FIG. 9 shows the cartridge 200 installed to or in the cartridge holder 150. Only part of the cartridge holder 150 is shown in FIG. 8 and FIG. 9. The cartridge holder 150 has a bottom 161 that faces the bottom wall 211 of the cartridge 200 when the cartridge 200 is in the installed position. A first positioning pin 151, a second positioning pin 152, a first fastening member 153, a second fastening member 154, multiple electrodes 155, a fluid supply needle 156 (referred to below as the ink supply needle), and a waste fluid recovery needle 157 are disposed to or on the bottom 161. Some of these elements extend upwardly (+Z direction) from the bottom 161. The multiple electrodes 155 may be formed by metal flat springs.

The first positioning pin 151 is a protrusion that is inserted to or in the first positioning hole 232 in the bottom wall 211 of the cartridge 200 when the cartridge 200 is installed to or in the cartridge holder 150. The second positioning pin 152 is a protrusion that is inserted to or in the second positioning hole 233 in the bottom wall 211 of the cartridge 200 when the cartridge 200 is installed to the cartridge holder 150. The first positioning pin 151 and second positioning pin 152 extend in the +Z direction. The first positioning pin 151 and second positioning pin 152 limit movement of the cartridge 200 on the X-axis and Y-axis inside the cartridge holder 150. The first positioning pin 151 and second positioning pin 152 are longer on the Z-axis or in the Z-axis direction than the ink supply needle 156 and the waste fluid recovery needle 157.

As a result, when the cartridge 200 is installed to or in the cartridge holder 150, the first positioning pin 151 and the second positioning pin 152 are respectively inserted to the first positioning hole 232 and second positioning hole 233 before the ink supply needle 156 and waste fluid recovery needle 157 are respectively inserted to or in the fluid supply port 230 and the waste fluid inlet 231. As a result, contact between the ink supply needle 156 and the waste fluid recovery needle 157 and the bottom of the cartridge 200 is suppressed, and damage to the ink supply needle 156 and the waste fluid recovery needle 157 is suppressed.

The first fastening member 153 and second fastening member 154 may be metal flat springs that hold and secure the cartridge 200 from the −Y direction and +Y direction. The first fastening member 153 and second fastening member 154 are in mutual opposition inside the cartridge holder 150. When the cartridge 200 is in the installed position, the first fastening member 153 opposes the fifth wall 215 and the first catch 240. The first fastening member 153 extends in the +Z direction from the +Y direction end of the bottom 161. When in the installed position, the second fastening member 154 opposes the second side wall 216 and the second catch 241. The second fastening member 154 extends in the +Z direction from the −Y direction end of the bottom 161. The first fastening member 153 may also be referred to as a first lock spring, and the second fastening member 154 as a second lock spring.

As shown in FIG. 9, the first fastening member 153 has, on the +Z direction end, a hook 153*a* into which the first catch 240 facing the +Y direction fits. The first fastening member 153 also has, on the +Z direction side of the hook 153*a*, an inclined surface 153*b* that separates from the fifth wall 215 as it rises in the +Z direction.

The second fastening member 154 has, on the +Z direction end, a hook 154*a* into which the second catch 241 facing the −Y direction fits. The second fastening member 154 also has, on the +Z direction side of the hook 154*a*, an inclined surface 154*b* that separates from the second side wall 216 as the inclined surface 154*b* rises in the +Z direction.

The hook 153*a* and the hook 154*a* are at the same elevation on the Z-axis. The hooks 153*a*, 154*a* and the inclined surfaces 153*b*, 154*b* are formed by bending the flat first fastening member 153 and second fastening member 154.

When the cartridge 200 is inserted in the insertion direction to or in the cartridge holder 150, the first positioning pin 151 is inserted to or in the first positioning hole 232, and the second positioning pin 152 is inserted to or in the second positioning hole 233. The first catch 240 also contacts the inclined surface 153*b* of the first fastening member 153 and pushes the first fastening member 153 out in the +Y direction. The second catch 241 contacts the inclined surface

154*b* of the second fastening member 154 and pushes the second fastening member 154 out in the −Y direction.

As the cartridge 200 is inserted further therefrom in the insertion direction, the ink supply needle 156 is inserted to or in the fluid supply port 230, the waste fluid recovery needle 157 is inserted to or in the waste fluid inlet 231, and the electrode contacts 250 disposed to the inclined portion 219 of the cartridge 200 contact the electrodes 155 disposed to or on the cartridge holder 150.

Finally, the first catch 240 fits into the hook 153*a* of the first fastening member 153, the second catch 241 fits into the hook 154*a* of the second fastening member 154, and the cartridge 200 is installed and secured in the cartridge holder 150. In this installation position, the cartridge 200 is subject to repulsion in the +Z direction from the electrodes 155, which are formed by flat springs in one example, and from springs 31, 41 (FIG. 14, FIG. 15) disposed inside the fluid supply port 230 and the waste fluid inlet 231.

As a result, when removing the cartridge 200 in the +Z direction from the cartridge holder 150, the removal is assisted by this repulsion force and the cartridge 200 can be easily removed from the cartridge holder 150 by holding the grip 201 and pulling the cartridge 200 in the +Z direction.

Figure 10:
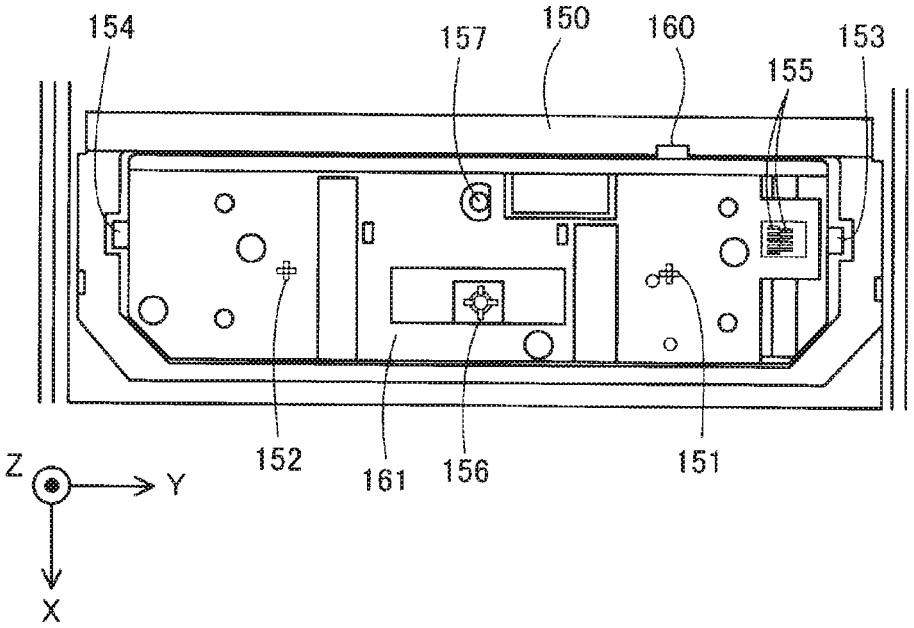
FIG. 10 is a top view of the cartridge holder.
Figure 11:
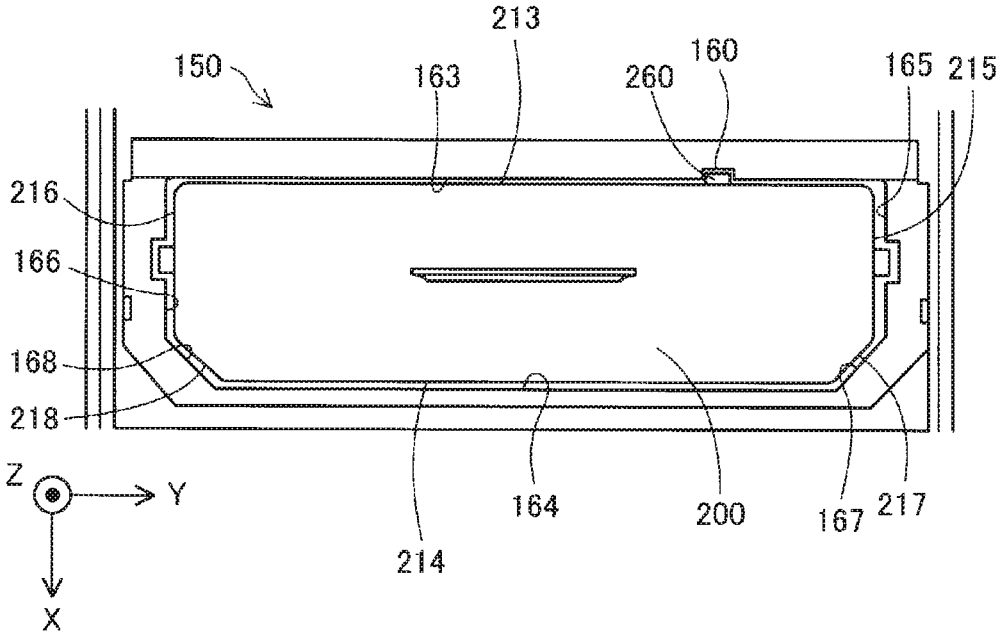
FIG. 11 is a top view of the cartridge installed to or in the cartridge holder.

FIG. 10 is a top view of the cartridge holder 150. FIG. 11 is a top view of the cartridge 200 installed in the cartridge holder 150. In this embodiment, the cartridge 200 is roughly hexagonal (e.g., roughly 6 sides) when seen from the insertion direction. More specifically, the shapes of the cartridge 200 on the top, bottom, and in section perpendicular to the insertion direction are roughly hexagonal. In this embodiment, the shape of the cartridge holder 150 is also roughly hexagonal when seen in the insertion direction in order to conform to the shape of the cartridge 200. In other words, the shapes of the cartridge 200 and cartridge holder 150 are substantially the same when seen in the insertion direction.

The cartridge holder 150 includes inside walls 163 to 168 corresponding to the walls 213 to 218 forming the sides of the cartridge 200 when installed. In other words, when the cartridge 200 is installed, the cartridge holder 150 has an inside wall 163 opposite the third wall 213, an inside wall 164 opposite the fourth wall 214, an inside wall 165 opposite the fifth wall 215, an inside wall 166 opposite the sixth wall 216, an inside wall 167 opposite the seventh wall 217, and an inside wall 168 opposite the eighth wall 218. Of these inside walls 163 to 168, a channel 160 extending on the Z-axis is formed in the inside wall 163 opposite the third wall 213 of the cartridge 200. The wrong-insertion prevention pin 260 disposed to the third wall 213 of the cartridge 200 fits into this channel 160 when the cartridge 200 is installed in the cartridge holder 150. More specifically, the wrong-insertion prevention ping 260 fits into the channel 160 when the cartridge 200 is being inserted or installed correctly. If an attempt were made to insert the cartridge upside down, the wrong-insertion prevention pin 260 would not align with the channel 160 and incorrect insertion would be prevented. The roughly hexagonal shape may also help prevent the cartridge from being inserted incorrectly.

Figure 12:
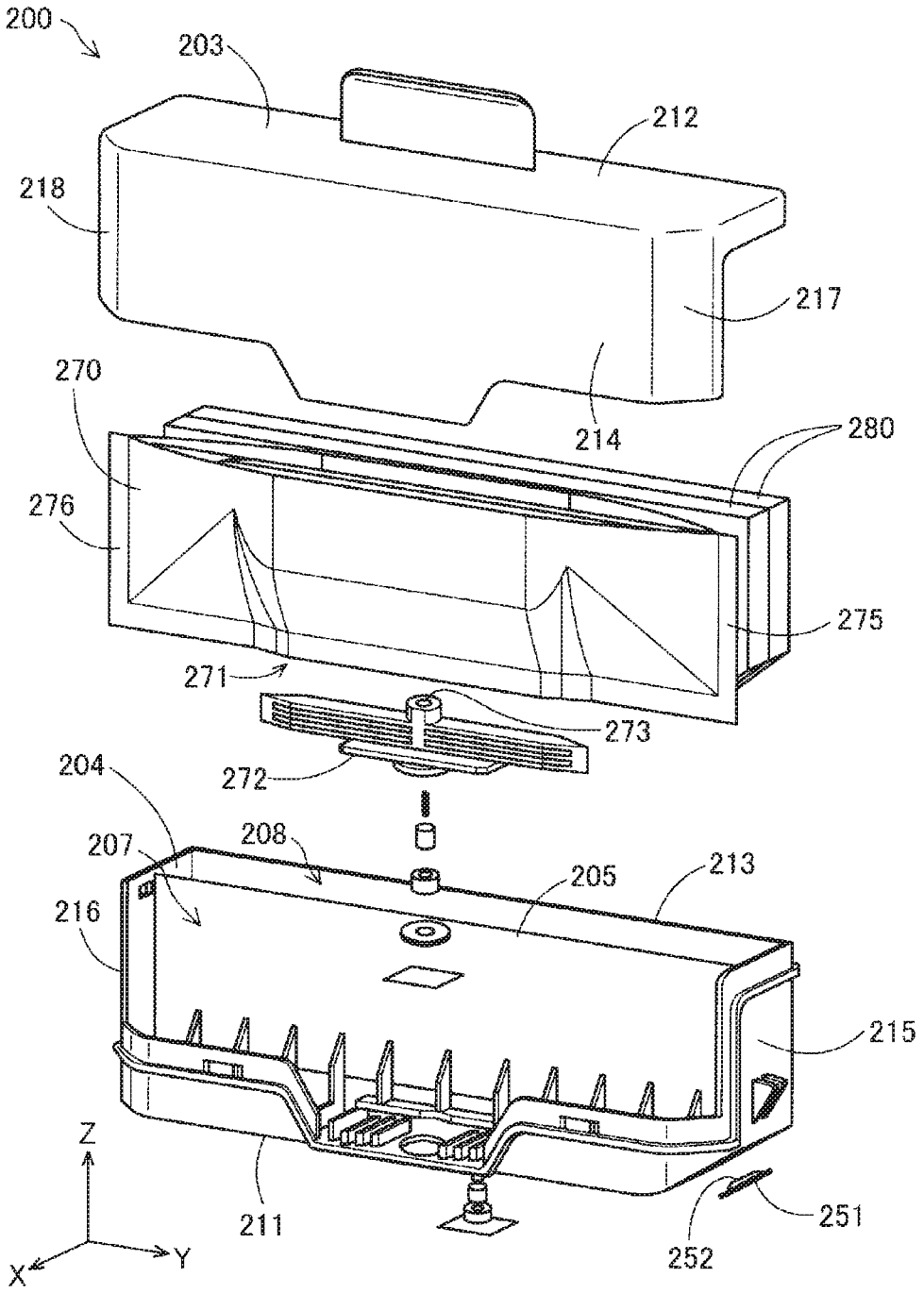
FIG. 12 is a partially exploded view of an example configuration of the cartridge.
Figure 13:
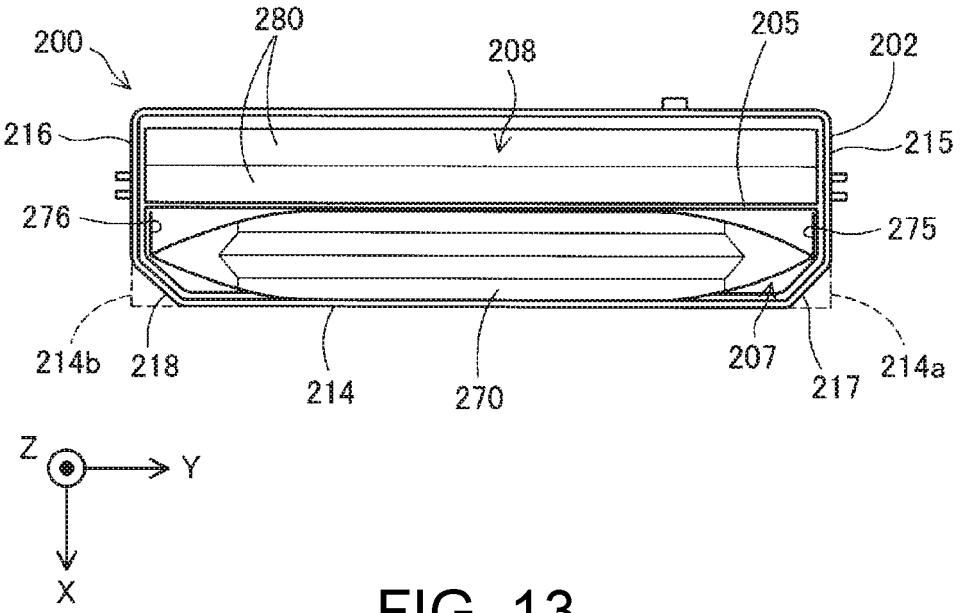
FIG. 13 illustrates an example of an internal configuration of the cartridge.

FIG. 12 is a partially exploded oblique view illustrating an example of a configuration of the cartridge 200. FIG. 13 illustrates an internal configuration of the cartridge 200. As described above, the cartridge 200 may include a top member 203 and bottom member 204. The top member 203 comprises the second wall 212, the fourth wall 214, the seventh wall 217, and the eighth wall 218 in one embodiment. The bottom member 204 comprises the first wall 211, the third wall 213, the fifth wall 215, and the sixth wall 216 in one embodiment.

In approximately the center of the internal space of the bottom member 204 is a divider 205 that is arranged along the Y-axis and Z-axis. The divider 205 divides the inside of the cartridge 200 into a fluid storage chamber 207 and a waste fluid storage chamber 208. A flexible fluid pack 270 is disposed inside the fluid storage chamber 207. Ink for supply to the printer 100 is stored in the fluid pack 270. A waste fluid holder 280 for holding waste fluid recovered from the printer 100 is disposed inside the waste fluid storage chamber 208. In other words, in this embodiment, a fluid pack 270 and waste fluid holder 280 are disposed side by side on the X-axis inside the case 202 of the cartridge 200. The fluid pack 270 and the waste fluid holder 280 may be separated by the divider 205. The entire divider 205 extends on the −Z direction to the bottom wall 211. As a result, waste fluid is prevented from flowing from the waste fluid storage chamber 208 into the fluid storage chamber 207.

The waste fluid holder 280 may have a rectangular body that can hold or store waste fluid inside. A porous material such as a sponge or nonwoven cloth, or a superabsorbent polymer, for example, may be used as the waste fluid holder 280. In this embodiment, two waste fluid holders 280 are disposed side by side on the X-axis.

The fluid pack 270 is made by bonding one or more plastic films, such as polyethylene films, along the outside edges. An opening 271 is disposed in the bottom of the fluid pack 270. A flow channel member 272 is disposed in the opening 271. A flow channel 273 is formed on the Z-axis in the flow channel member 272 for discharging ink inside the fluid pack 270 to the outside. The fluid pack 270 and flow channel member 272 are bonded by a heat seal, for example.

At the +Y direction end and −Y direction end of the fluid pack 270 are respectively formed flat bonding margins 275, 276 by bonding two sheets of plastic film together. When the fluid pack 270 is placed inside the fluid storage chamber 207, these bonding margins 275, 276 are folded in on the +X direction or −X direction as shown in FIG. 13 inside the fluid storage chamber 207.

As shown in FIG. 13, the two corners 214*a*, 214*b* of the side (fourth wall 214) of the cartridge 200 case 202 on which the fluid pack 270 is disposed are beveled. The seventh wall 217 and eighth wall 218 in this embodiment are formed by beveling these corners 214*a*, 214*b*. The thickness of the walls forming the sides of the case 202 is substantially constant. As a result, by beveling the corners 214*a*, 214*b*, the shape of the inside surface of the fluid storage chamber 207 is roughly hexagonal when seen in the insertion direction.

In this embodiment, when ink is stored in the fluid pack 270, the length of the fluid pack 270 on the Y-axis, not including the bonding margins 275, 276 of the fluid pack 270, is substantially the same as the distance between the fifth wall 215 and the sixth wall 216 of the cartridge 200. As a result, when the fluid pack 270 is placed inside the fluid storage chamber 207, the base of bonding margin 275 of the fluid pack 270 contacts the inside corner of the fifth wall 215 and seventh wall 217, and the base of bonding margin 276 of the fluid pack 270 contacts the inside corner of the sixth wall 216 and eighth wall 218. Note that the position on the X-axis of the inside corner of the fifth wall 215 and seventh wall 217, and the inside corner of the sixth wall 216 and eighth wall 218, is approximately the center of the width of the fluid storage chamber 207 on the X-axis.

As shown in FIG. 13, both corner 214*a* and corner 214*b* are beveled in this embodiment, but a configuration in which only one of the corner 214*a* and the corner 214*b* is beveled is also possible. In other words, one of seventh wall 217 and eighth wall 218 may be omitted. If the seventh wall 217 is omitted, the cartridge 200 has a corner formed by the intersection of the fourth wall 214 and the fifth wall 215 at the area corresponding to the seventh wall 217. If the eighth wall 218 is omitted, the cartridge 200 has a corner formed by the intersection of the fourth wall 214 and the sixth wall 216 at the area corresponding to the eighth wall 218.

Figure 14:
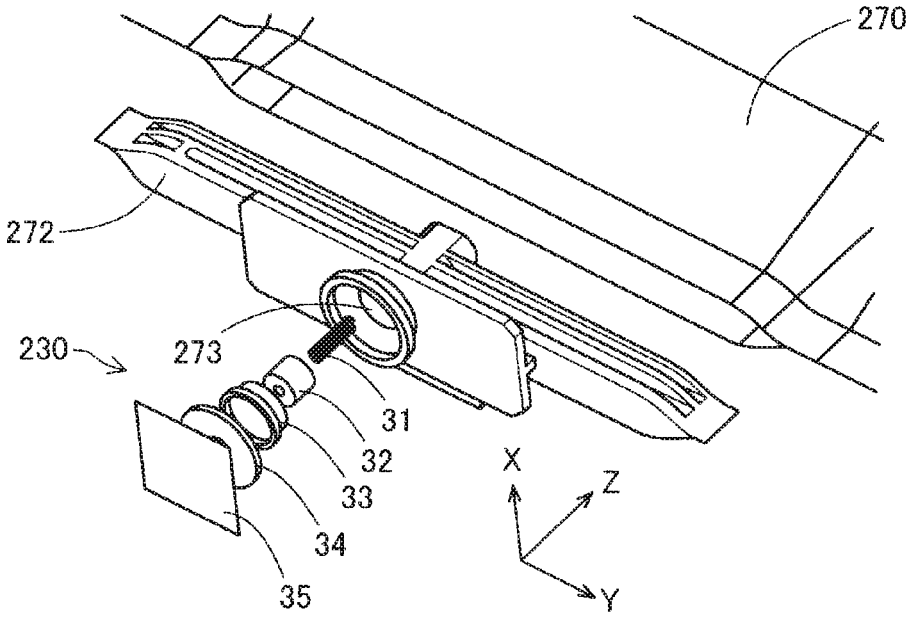
FIG. 14 is a partially exploded view of an example configuration of a fluid supply port.

FIG. 14 is an exploded oblique view showing an example of a configuration of the fluid supply port 230. The fluid supply port 230 is configured by inserting in the flow channel 273 of the flow channel member 272, sequentially from the +Z direction, a spring 31, a valve plug 32, packing 33, and an absorber 34. These are then sealed by a film 35 on the −Z direction side.

When the cartridge 200 is not installed in the cartridge holder 150, that is, when the ink supply needle 156 is not inserted to or in the fluid supply port 230, ink inside the fluid pack 270 is prevented from leaking from the fluid supply port 230 by the spring 31 pushing the valve plug 32 against the packing 33.

When the cartridge 200 is installed in the cartridge holder 150, that is, when the ink supply needle 156 is inserted to or in the fluid supply port 230, the ink supply needle 156 punctures the film 35 and pushes the valve plug 32 to or towards the fluid pack 270 side.

As a result, ink flows from inside the fluid pack 270 to between the valve plug 32 and the packing 33. That ink then flows into the fluid injection opening in the distal end of the ink supply needle 156. Thus, the ink is supplied to the printer 100.

The absorber 34 may be a porous material such as a sponge or nonwoven cloth. The absorber 34 suppresses leakage of ink from the fluid supply port 230, along the outside surface of the ink supply needle 156, and into the cartridge holder 150.

Note that, as shown in FIG. 14, the fluid supply port 230 is disposed to the flow channel member 272 disposed to or in the fluid pack 270. Because the fluid supply port 230 is exposed to the outside from the bottom wall 211, the fluid supply port 230 may also be considered to be disposed to or towards the bottom wall 211.

Figure 15:
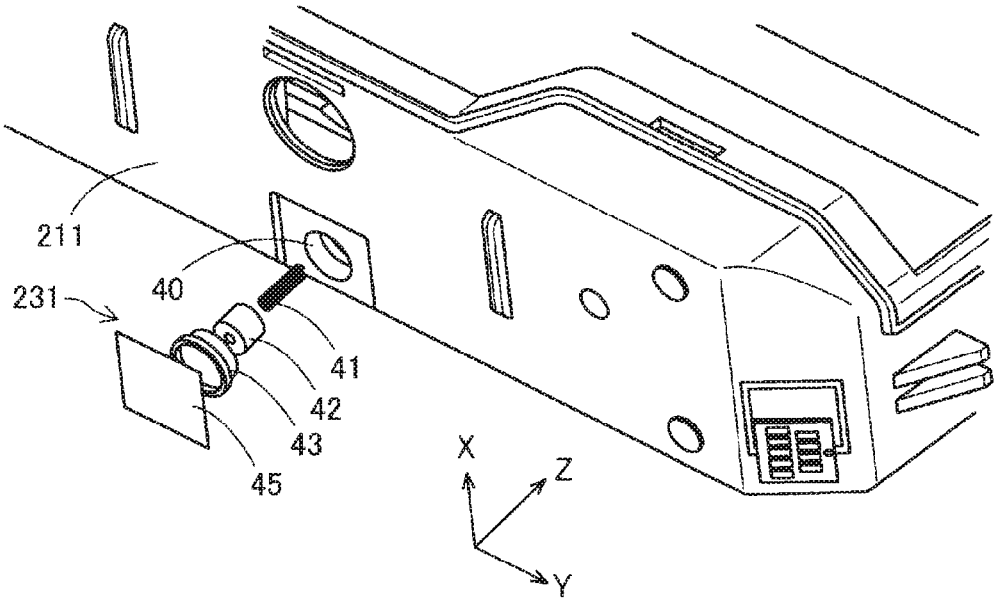
FIG. 15 is a partially exploded view of an example configuration of a waste fluid inlet.

FIG. 15 is a partially exploded oblique view illustrating an example of a configuration of the waste fluid inlet 231. The waste fluid inlet 231 is configured by inserting, in a hole 40 that is disposed in the bottom wall 211 and that communicates with the waste fluid storage chamber 208, sequentially from the +Z direction, a spring 41, a valve plug 42, and packing 43. These are sealed by a film 45 on the −Z direction side.

When the cartridge 200 is not installed in the cartridge holder 150, that is, when the waste fluid recovery needle 157 is not inserted to or in the waste fluid inlet 231, waste fluid inside the waste fluid storage chamber 208 is prevented from leaking from the waste fluid inlet 231 as a result of the spring 41 pushing the valve plug 42 against the packing 43.

When the cartridge 200 is installed in the cartridge holder 150, that is, when the waste fluid recovery needle 157 is inserted to or in the waste fluid inlet 231, the waste fluid recovery needle 157 punctures the film 45 and pushes the valve plug 42 to or towards the waste fluid storage chamber 208 side. As a result, the waste fluid supply hole in the distal end of the waste fluid recovery needle 157 communicates with the waste fluid storage chamber 208, and waste fluid discharged from the printer 100 through the waste fluid recovery needle 157 flows into the waste fluid storage chamber 208, and is absorbed by the waste fluid holder 280.

Figure 16:
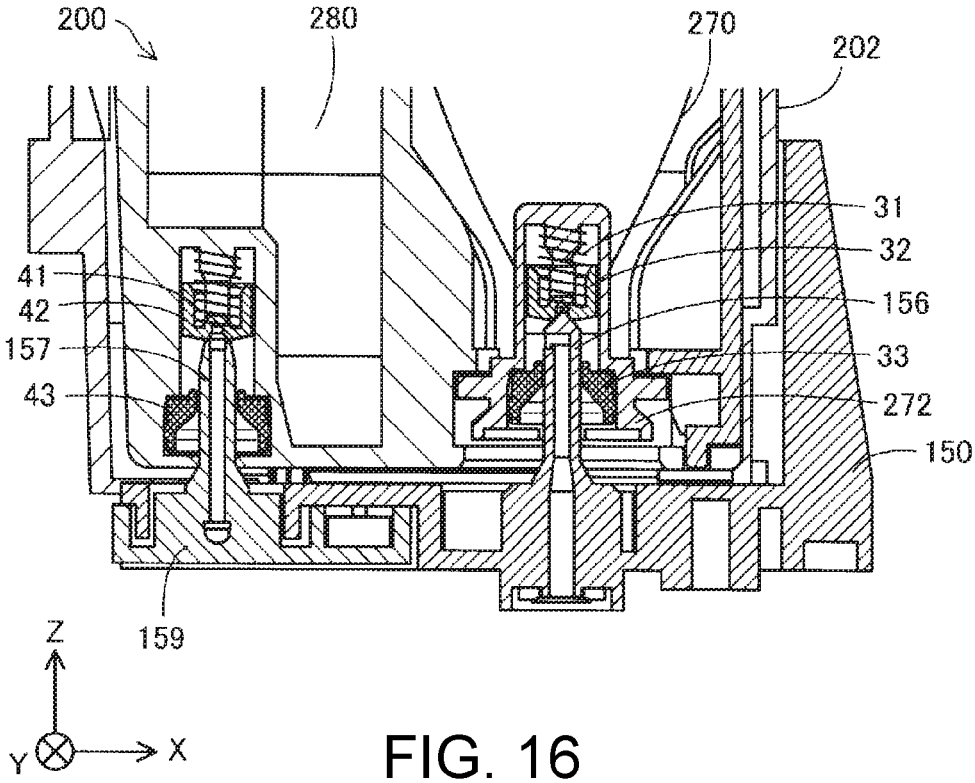
FIG. 16 is a section view through the Z-X plane of the cartridge and cartridge holder.

FIG. 16 is a section view on the Z-X plane of the cartridge 200 and cartridge holder 150.

In this embodiment, the ink supply needle 156 may be formed in unison with the cartridge holder 150. As a result, the ink supply needle 156 cannot move relative to the cartridge holder 150.

In contrast, the waste fluid recovery needle 157 may not be formed in unison with the cartridge holder 150. The waste fluid recovery needle 157 may be formed on or in a waste fluid flow channel member 159, which has a flow channel connected to a pump for pressure feeding the waste fluid.

The waste fluid flow channel member 159 is fit to or in the cartridge holder 150 with play. This allows, in one embodiment, a specific amount of movement in the X-axis and Y-axis or in the X-axis and Y-axis directions. The waste fluid recovery needle 157 can therefore move on the X-axis and Y-axis relative to the waste fluid inlet 231 as result of movement of the waste fluid flow channel member 159.

The ink supply needle 156 is stationary on the cartridge holder 150, and the flow channel member 272 in which the fluid supply port 230 is formed is attached to the case 202 of the cartridge 200 with play allowing a specific amount of movement on the X-axis and Y-axis. As a result, in this example, the ink supply needle 156 can move on the X-axis and Y-axis (or in the X-axis and Y-axis directions) relative to the fluid supply port 230.

Note that in this embodiment both the ink supply needle 156 and the waste fluid recovery needle 157 can move relative to the X-axis and Y-axis, but configurations in which both the ink supply needle 156 and waste fluid recovery needle 157 are stationary, or only one can move, are also conceivable. Note that "play" as used herein is a movement of a distance greater than the design tolerance of the positioning error of the ink supply needle 156 and waste fluid recovery needle 157.

As shown in FIG. 6, in this embodiment, when the cartridge 200 is seen from the bottom wall 211 side, an imaginary first line L1 through the first catch 240 held by the first fastening member 153, and the second catch 241 held by the second fastening member 154, passes through or between the fluid supply port 230 and waste fluid inlet 231. Therefore, because insertion of the ink supply needle 156 and waste fluid recovery needle 157 to the fluid supply port 230 and waste fluid inlet 231 can be stabilized, the cartridge 200 can be stably affixed or attached to the cartridge holder 150.

More particularly, because springs 31, 41 are respectively disposed to or are part of or are included in the fluid supply port 230 and waste fluid inlet 231 in this embodiment, in the installation position, the springs 31, 41 produce repulsion pushing the cartridge 200 up from the cartridge holder 150. However, as described above, because the imaginary first line L1 passing through the first catch 240 held by the first fastening member 153, and the second catch 241 held by the second fastening member 154, passes through the fluid supply port 230 and waste fluid inlet 231, tilting of the cartridge 200 inside the cartridge holder 150 can be suppressed even when the cartridge 200 is subject to the repulsion force of the springs 31, 41.

Because tilting of the cartridge 200 inside the cartridge holder 150 is thus suppressed in this embodiment, contact between the ink supply needle 156 and the fluid supply port 230, and contact between the waste fluid recovery needle 157 and the waste fluid inlet 231, is stabilized. Breakage of or damage to the ink supply needle 156 and waste fluid recovery needle 157 can be suppressed, and leakage of ink or waste fluid from the cartridge 200 can therefore be suppressed. In addition, because tilting of the cartridge 200 inside the cartridge holder 150 is suppressed in this embodiment, excessive rubbing between the positioning pins 151, 152 and positioning holes 232, 233 is also suppressed when installing and removing the cartridge 200. As a result, the cartridge 200 can be smoothly installed and removed.

Furthermore, because excessive rubbing between the positioning pins 151, 152 and the positioning holes 232, 233 is suppressed, wearing of the positioning pins 151, 152 and positioning holes 232, 233 is also suppressed. As a result, becoming unable to install the cartridge 200 to the normal position can be suppressed. In other words, it may become more difficult to install the cartridge 200 as the positioning pins and positioning holds wear. By suppressing the positioning pins and positioning hole from wearing, a user is less likely to have trouble installing the cartridge 200 correctly. Note that "passing" or "going through" as used herein means, when the object being passed has a specific area or range, passing any desired position in that area or range.

When looking at the cartridge 200 from the bottom wall 211 side, the distance between the first catch 240 and second catch 241 in this embodiment is greater than the distance between the fluid supply port 230 and waste fluid inlet 231. As a result, the cartridge 200 can be more stably attached to the cartridge holder 150. More particularly in this embodiment, because the first catch 240 and second catch 241 are disposed to or on the walls 215 and 216 with the greatest distance therebetween, the distance between the first catch 240 and second catch 241 can be increased. As a result, the posture of the cartridge 200 inside the cartridge holder 150 can be further stabilized.

In addition, because the first catch 240 and second catch 241 are at a position that is half of the distance between the bottom wall 211 and second wall 212 in one example, the cartridge 200 can more stably be attached in the cartridge holder 150. The first catch 240 and the second catch 241 can be positioned at locations that are not half of the distance between the bottom wall 211 and the second wall 212.

Furthermore, because the first catch 240 and second catch 241 in this embodiment are at the same position on the Z-axis, the cartridge 200 can be easily inserted and removed from the cartridge holder 150 while remaining horizontal.

Yet further, because the shape of the cartridge holder 150 when seen from the insertion direction matches the shape of the cartridge 200 when seen in the insertion direction, and because their shapes are substantially the same, the case 202 of the cartridge 200 contacting the inside walls 213 to 218 of the cartridge holder 150 when pulling the cartridge 200 out, and difficulty in removing the cartridge 200 from the cartridge holder 150, can be suppressed.

When looking at the cartridge 200 from the bottom wall 211 in this embodiment, the electrode contacts 250 are between the first catch 240 and second catch 241. As a result, the electrode contacts 250 can more stably contact the electrodes 155.

In addition, in this embodiment the distance between the first positioning hole 232 and second positioning hole 233 is greater than the distance between the fluid supply port 230 and waste fluid inlet 231. As a result, the precision of positioning the cartridge 200 to the cartridge holder 150 can be increased, and as a result, the fluid supply port 230 and waste fluid inlet 231 can be connected to the ink supply needle 156 and waste fluid recovery needle 157 with good precision.

Furthermore, in this embodiment, as shown in FIG. 6, in the direction (in this embodiment, the X-axis) along an imaginary second line L2 through the fluid supply port 230 and waste fluid inlet 231, the locations of the first catch 240 and the second catch 241 are between the fluid supply port 230 and the waste fluid inlet 231. As a result, the cartridge 200 can be more stably affixed to the cartridge holder 150. Furthermore, because the first line L1 and the second line L2 are perpendicular to each other, the cartridge 200 can be even more stably affixed to the cartridge holder 150.

In this embodiment, as also shown in FIG. 6, when looking at the cartridge 200 from the bottom wall 211 side, an imaginary first line L1 passes between the two most separated electrode contacts 250*a*, 250*b* in the group of multiple electrode contacts 250. As a result, good contact can be made between the terminals (electrode contacts 250) disposed to or on the cartridge 200, and the electrodes 155 disposed to or on the cartridge holder 150. Data can therefore be read more accurately from the memory device 252. More particularly, contact and reading accuracy are further improved because the electrodes 155 are made from flat springs in this embodiment, and the electrodes 155 push against the cartridge 200 in the installed position.

Furthermore, in this embodiment, as shown in FIG. 4, because the electrode contacts 250 are disposed to or on the inclined portion 219 of the cartridge 200, the electrodes 155 are contacted by the electrode contacts 250 while sliding against the surface of the electrode contacts 250 when the cartridge 200 is installed to or in the cartridge holder 150. Therefore, dust, ink, and other foreign matter that may cling to the electrodes 155 or the electrode contacts 250 can be removed. As a result, good contact can be made between the electrode contacts 250 disposed to the cartridge 200 and the electrodes 155 disposed to the cartridge holder 150.

Also in this embodiment, as shown in FIG. 6, when looking at the cartridge 200 from the bottom wall 211 side, an imaginary third line L3 through the first positioning hole 232 and the second positioning hole 233 passes between the fluid supply port 230 and waste fluid inlet 231. As a result, the positioning precision of the cartridge 200 to the cartridge holder 150 can be improved.

Also in this embodiment, as shown in FIG. 4, the bottom wall 211 includes protrusions 234, 235 that project further to the cartridge holder 150 side (−Z direction) than the fluid supply port 230 and waste fluid inlet 231. Therefore, when the cartridge 200 is set on a table, for example, touching and soiling the table with the fluid supply port 230 and the waste fluid inlet 231 can be suppressed. Furthermore, because the fluid supply port 230 and the waste fluid inlet 231 are located between the protrusions 234, 235 on the Y-axis, touching the table with the fluid supply port 230 and the waste fluid inlet 231 can be suppressed even more effectively.

Figure 17:
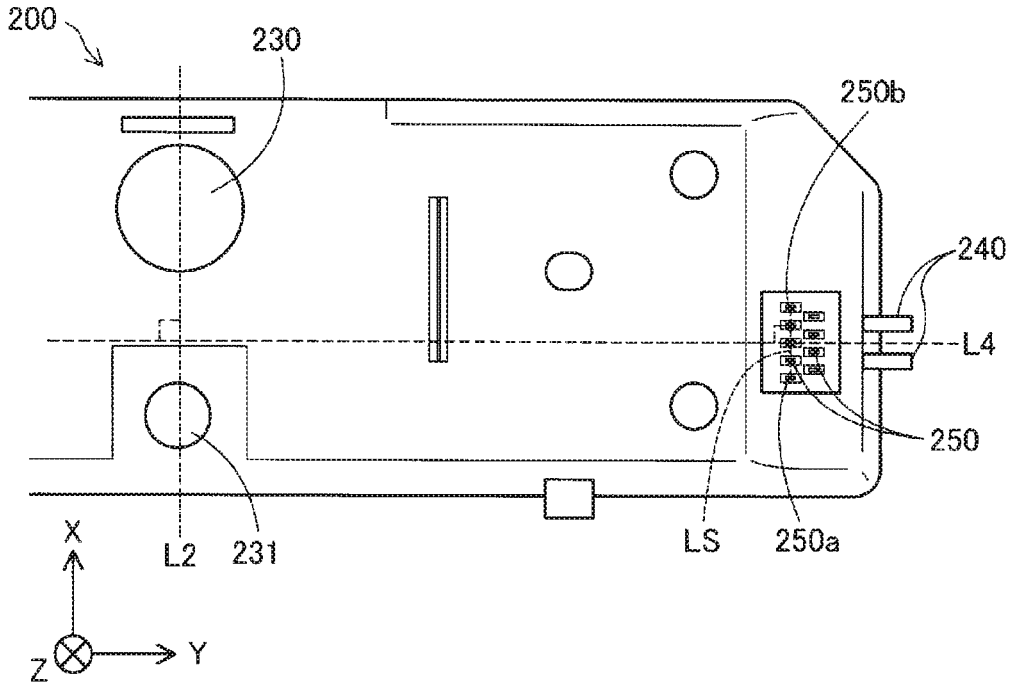
FIG. 17 is a bottom view of the area around electrode contacts of the cartridge.

FIG. 17 is a bottom view of the area around the electrode contacts 250 of the cartridge 200. In this embodiment, as also shown in FIG. 6 and FIG. 17, when looking at the cartridge 200 from the bottom wall 211, an imaginary fourth line L4, which is perpendicular to and passes through the center of a line segment LS connecting the two most separated electrode contacts 250*a*, 250*b* in the group of multiple electrode contacts 250 (in this embodiment, the two electrode contacts 250*a*, 250*b* are separated the most on the X-axis), passes between the fluid supply port 230 and waste fluid inlet 231.

As a result, because three positions (fluid supply port 230, waste fluid inlet 231, electrode contacts 250) on the bottom of the cartridge 200 contact the cartridge holder 150 and are arranged in a triangle, the cartridge 200 can be placed stably in the cartridge holder 150. In addition, because the imaginary second line L2 through the fluid supply port 230 and waste fluid inlet 231 is perpendicular to the fourth line L4, the three positions of the cartridge 200 that contact the cartridge holder 150 form an acute triangle. As a result, the cartridge 200 can be positioned even more stably in the cartridge holder 150.

Furthermore, because the corners 214*a*, 214*b* of the wall (fourth wall 214) on the side of the case 202 where the fluid pack 270 is located are beveled as shown in FIG. 11 and FIG. 13, movement of the ends of the fluid pack 270 can be restricted without adding ribs or other shapes inside the case 202. The shape of the fluid pack 270 inside the cartridge 200 can therefore be stabilized. As a result, wrinkling or damage to the fluid pack 270 during transportation of the cartridge 200, for example, can be suppressed.

Furthermore, because in this embodiment the corners of the wall of the cartridge 200 on the side where the fluid pack 270 is located are beveled, and the corners of the wall on the side where the waste fluid holder 280 is located are not beveled, the capacity of the waste fluid storage chamber 208 is increased and a greater amount of waste fluid can be stored in the waste fluid storage chamber 208.

In one embodiment, the fluid pack and the waste fluid retainer are disposed inside the case or inside the cartridge 200. The fluid pack is positioned on one side of the inside of the case and the waste fluid retainer is positioned on the other side of the inside of the case. The fluid pack is located on the side of the case that is associated with the beveled corner or corners. This configuration can ensure that the fluid pack is stably held inside the case. The fluid pack and the waste fluid retainer may be completely or partially separated by a divider that is located in a center portion of the inside of the case.

In addition, by beveling the corners on one side of the cartridge 200, the shape of the cartridge 200 is obviously different depending on the direction from which it is seen. Installing the cartridge 200 to the cartridge holder 150 in the wrong direction can therefore be suppressed. More particularly, because the shape of the cartridge holder 150 conforms to the shape of the cartridge 200 in this embodiment, installing the cartridge 200 with the front and back sides reversed can be reliably prevented.

Furthermore, in this embodiment, a wrong-insertion prevention pin 260 that fits into a channel 160 formed in the inside wall 163 of the cartridge holder 150 is formed on the side of the cartridge 200, and when seen in the insertion direction, this wrong-insertion prevention pin 260 is located at a position offset from the center of the side on which the wrong-insertion prevention pin 260 is formed. Installation of the cartridge 200 with the top and bottom reversed (with the cartridge 200 upside down) can therefore also be suppressed. Installing the cartridge 200 in the wrong orientation can therefore be more reliably suppressed.

Furthermore, as shown in FIG. 16, the ink supply needle 156 in this embodiment can move on the X-axis and Y-axis relative to the fluid supply port 230. The waste fluid recovery needle 157 can also move, by movement of the waste fluid flow channel member 159, on the X-axis and Y-axis relative to the waste fluid inlet 231.

As a result, the ink supply needle 156 and waste fluid recovery needle 157 can be desirably inserted even if the positions of the ink supply needle 156 and the fluid supply port 230, or the positions of the waste fluid recovery needle 157 and the waste fluid inlet 231, vary due to production variations. Ink or waste fluid leaking from the cartridge 200 due to production differences can therefore be suppressed.

Furthermore, because the ink supply needle 156 and waste fluid recovery needle 157 can move in relation to the fluid supply port 230 and the waste fluid inlet 231, dimensional tolerances of the ink supply needle 156 and the fluid supply port 230, or the waste fluid recovery needle 157 and the waste fluid inlet 231, relative to the positioning holes 232, 233 and the positioning pins 151, 152 can be absorbed or accommodated. Advantageously, the production yield of the cartridge 200 can therefore be improved.

B. Variations

Variation 1

Ink is stored in the fluid pack 270 in the embodiment described above. However, ink may be stored directly in the fluid storage chamber 207. Waste fluid may also be stored directly in the waste fluid storage chamber 208.

Variation 2

In the embodiment described above, the fluid supply port 230 and waste fluid inlet 231 are at the same position on the Y-axis. However, the fluid supply port 230 and waste fluid inlet 231 may be at different positions on the Y-axis.

Variation 3

In the embodiment described above, the first catch 240 and second catch 241 are at the same position on the X-axis. However, the first catch 240 and second catch 241 may be at different positions on the X-axis.

Variation 4

In the embodiment described above, the first positioning hole 232 and second positioning hole 233 are at the same position on the X-axis. However, the first positioning hole 232 and second positioning hole 233 may be at different positions on the X-axis.

Variation 5

In the embodiment described above, in the direction along the imaginary second line L2 through the fluid supply port 230 and the waste fluid inlet 231 when looking at the cartridge 200 from the bottom wall 211, the locations of the first catch 240 and second catch 241 are not limited to being between the fluid supply port 230 and the waste fluid inlet 231. Both or either one of the first catch 240 and second catch 241 may be outside of or removed from between the fluid supply port 230 and waste fluid inlet 231.

Variation 6

In the embodiment described above, when looking at the cartridge 200 from the bottom wall 211, the first line L1 may be other than perpendicular to the imaginary second line L2 through the fluid supply port 230 and waste fluid inlet 231.

Variation 7

In the embodiment described above, when looking at the cartridge 200 from the bottom wall 211, the first line L1 does not need to pass through the two most separated electrode contacts 250 in the group of multiple electrode contacts 250.

Variation 8

In the embodiment described above, the cartridge 200 may be configured without an inclined portion 219. In this case, the electrode contacts 250 may be disposed to or on the bottom wall 211, for example.

Variation 9

In the embodiment described above, the wrong-insertion prevention pin 260 may be disposed in the center of the side where the wrong-insertion prevention pin 260 is disposed. The wrong-insertion prevention pin 260 is also not limited to being located on the third wall 213, and may be disposed to the fourth wall 214, fifth wall 215, sixth wall 216, seventh wall 217, eighth wall 218, or other desirable surface of the case 202.

Variation 10

In the embodiment described above, the cartridge 200 has one fluid supply port 230 and one waste fluid inlet 231.

However, the cartridge 200 may have two or more fluid supply ports 230 and/or two or more waste fluid inlets 231.

Variation 11

In the embodiment described above, the inside and outside surfaces of the seventh wall 217 and the eighth wall 218 are flat. However, the inside surface or outside surface of at least one of the seventh wall 217 and the eighth wall 218 may be curved. The curve may be convex (protrude) to the outside, or convex (protrude) to the inside. The inside surface or outside surface of the second wall 212, the third wall 213, the fourth wall 214, the fifth wall 215 or the sixth wall 216 may also be curved.

Variation 12

In the embodiment described above, the first line L1 shown in FIG. 6 is a line through the first catch 240 and the second catch 241. However, the first line L1 may be a line through a first contact part that contacts the first fastening member 153, and a second contact part that contacts the second fastening member 154. For example, if the first catch 240 and the second catch 241 cover the full range of the fifth wall 215 and sixth wall 216 along the X-axis, the first line L1 may simply pass through the parts thereof that actually contact the first fastening member 153 and the second fastening member 154, and pass between the fluid supply port 230 and waste fluid inlet 231.

Variation 13

The cartridge 200 according to the embodiment described above is not limited to an off-carriage of a printer, and may also be used in an on-carriage printer having a cartridge holder disposed to or attached to a carriage such that the cartridge holder moves with the carriage. The printer 100 may also be a printer in which multiple cartridges 200 can be installed. The printer 100 is also not limited to business applications, and may be a consumer printer used at home.

Variation 14

Embodiments of the invention are not limited to inkjet printers and inkjet printer cartridges, and can be applied to fluid ejection devices that consume fluids other than ink and cartridges for such fluid ejection devices. For example, the invention can be used in the following types of fluid ejection devices and cartridges:

(1) Fax machines and image recording devices
(2) Colorant ejection devices that eject color materials used in the manufacture of color filters for LCD devices and other image display devices
(3) Electrode material ejection devices that eject electrode materials used in the formation of electrodes for organic electro-luminescence display devices, and field-emission display devices
(4) Fluid ejection devices for ejecting fluids including biological materials used in biochip manufacturing
(5) Ejection devices used as precision pipettes
(6) Lubricant ejection devices
(7) Resin ejection devices
(8) Fluid ejection devices for pinpoint ejection of lubricants in timepieces, cameras, and other precision mechanical devices
(9) Fluid ejection devices for ejecting transparent resins onto circuit boards, such as UV-curing resins for the manufacture of hemispherical lenses (optical lenses) used in optical communication devices
(10) Fluid ejection devices for ejecting acidic or alkaline etching fluids for etching circuit boards, for example
(11) Fluid ejection devices having a fluid ejection head for ejecting droplets of other desirable liquids or fluids A droplet as used herein refers to the state of a liquid ejected from the fluid ejection device, and includes materials that when ejected are granular, tear drop, or leave a thread-like strand.

A fluid or liquid as used herein includes any material that a fluid ejection device can eject. For example, fluids include any material when the state of matter is liquid phase, including liquid materials of high or low viscosity; and materials in a liquid state such as sols, gels, and other types of inorganic solvents, organic solvents, solutions, liquid resins, and liquid metals (metallic melts).

Not limited to liquid as a single state of matter, fluid and liquid as used herein also include materials containing particles of functional materials comprising solids such as pigments and metallic particles dissolved, dispersed, or mixed in a solvent.

Typical examples of liquids include ink as described above, and liquid crystals. Inks also include water-based ink, oil-based ink, hot melt ink, and other types of liquid compositions.

The invention is also not limited to the embodiments and variations described above, and can be varied in many ways without departing from the scope of the accompanying claims. For example, technical features of the foregoing embodiments and variations corresponding to technical features of the examples described in the summary of the invention above can be replaced or combined as needed to solve all or part of the problem described above, or to achieve all or part of the effect described above. In addition, technical features that are not described as essential in the foregoing description of the invention may be omitted as appropriate.

What is claimed is:

1. A cartridge configured to be installed in a cartridge holder disposed to or in a fluid ejection device, the cartridge comprising:

a box-shaped case;

a fluid pack storing a fluid and disposed in the case; and a waste fluid retainer disposed beside the fluid pack in the case, wherein the waste fluid retainer is configured to hold waste fluid introduced from the fluid ejection device into the case;

wherein at least one corner of a side of the case on a side on which the fluid pack is disposed is beveled, and wherein the fluid pack and the waste fluid retainer are included along a direction crossing a length direction of the box-shaped case.

2. The cartridge according to claim 1, wherein a divider member is disposed in the box-shaped case the entire length direction of the box-shaped case between the fluid pack and the waste fluid retainer.

3. The cartridge according to claim 1, wherein the fluid supply port and the waste fluid inlet are included along the direction crossing the length direction.

4. A cartridge configured to be installed in a cartridge holder disposed to or in a fluid ejection device, the cartridge comprising:

a box-shaped case;

a fluid pack storing a fluid and disposed in the case; and a waste fluid retainer disposed beside the fluid pack in the case, wherein the waste fluid retainer is configured to hold waste fluid introduced from the fluid ejection device into the case;

wherein at least one corner of a side of the case on a side on which the fluid pack is disposed is beveled, wherein the case includes, in a side, a wrong-insertion prevention pin that, when the cartridge is installed in the cartridge holder, fits into a channel formed in an inside wall of the cartridge holder; and when looking at the case from the direction in which the cartridge is installed to or in the cartridge holder, the wrong-insertion prevention pin is located at a position that is offset from a center of the side to which the wrong-insertion prevention pin is disposed.

5. A cartridge configured to be installed in a cartridge holder disposed to or in a fluid ejection device, the cartridge comprising:

a box-shaped case;

a fluid pack storing a fluid and disposed in the case; and a waste fluid retainer disposed beside the fluid pack in the case, wherein the waste fluid retainer is configured to hold waste fluid introduced from the fluid ejection device into the case;

wherein at least one corner of a side of the case on a side on which the fluid pack is disposed is beveled, wherein the cartridge holder includes a first positioning pin and a second positioning pin protruding in a direction toward the case;

the case includes a bottom wall that includes a fluid supply port that communicates with the fluid pack, a waste fluid inlet that communicates with the waste fluid retainer, a first positioning hole configured to receive the first positioning pin when the cartridge is installed in the cartridge holder, and a second positioning hole configured to receive the second positioning pin when the cartridge is installed in the cartridge holder; and when looking at the case from the bottom wall side, an imaginary line through the first positioning hole and second positioning hole passes between the fluid supply port and the waste fluid inlet.

6. The cartridge according to claim 5, wherein:

the bottom wall includes a protrusion that projects farther than the fluid supply port and waste fluid inlet to the cartridge holder side.

* * * * *